United States Patent [19]

Baxter

[11] Patent Number: 4,765,393

[45] Date of Patent: Aug. 23, 1988

[54] THERMALLY REGENERATIVE HOT BEVERAGE CONTAINER

[76] Inventor: Keith M. Baxter, 8138 Aberdeen Ct., Wauwatosa, Wis. 53213

[21] Appl. No.: 147,586

[22] Filed: Jan. 21, 1988

Related U.S. Application Data

[63] Continuation of Ser. No. 911,885, Sep. 26, 1986, abandoned.

[51] Int. Cl.[4] ..... F24H 7/00; F28D 17/00

[52] U.S. Cl. ..... 165/47; 165/902; 126/400; 62/372; 62/529

[58] Field of Search ..... 165/47, 902; 62/457, 62/529, 371, 372; 126/400, 263

[56] References Cited

U.S. PATENT DOCUMENTS

| | | | |
|---|---|---|---|
| 2,526,165 | 10/1950 | Smith | 62/457 |
| 2,622,415 | 12/1952 | Landers et al. | 62/457 |
| 2,876,634 | 12/1954 | Zimmerman et al. . | |
| 3,463,140 | 10/1967 | Rollor . | |
| 3,603,106 | 9/1971 | Ryan . | |
| 3,766,975 | 10/1973 | Todd | 165/47 A |

*Primary Examiner*—Albert W. Davis, Jr.
*Attorney, Agent, or Firm*—Keith M. Baxter

[57] ABSTRACT

A beverage container with hollow walls and a hollow central member containing a phase-change material whose phase-change is selected to occur at the approximate temperature considered ideal for drinking, whereby the container regulates the temperature of beverage by absorbing and releasing heat from and to the beverage.

8 Claims, 2 Drawing Sheets

THERMALLY REGENERATIVE HOT BEVERAGE CONTAINER

This application is a continuation of application Ser. No. 911,885, filed Sept. 26, 1986, now abandoned.

FIELD OF THE INVENTION

This invention relates to regenerative temperature regulating beverage containers, and in particular to a beverage container whereby the temperature of a heated beverage is regulated by means of a melting, phase-change material held within the container's walls.

BACKGROUND OF THE INVENTION

Critical to the effective regenerative regulation of a beverage's temperature, through the use of a melting phase-change material is the speed of the regulation. The speed of regulation is determined in part by the ease with which heat may flow between the beverage and the phase change material. If the speed at which the beverage's heat is transferred to the phase-change material is slow, much of this heat will be irretrievably lost to the air, through the beverage's upper surface. As the beverage cools further, if the heat stored in the phase-change material cannot be quickly released, the temperature of the beverage will not be properly maintained.

A slow speed of temperature regulation will be unacceptable to a consumer who desires the contained beverage be quickly reduced to a drinkable temperature and maintained at that temperature for the longest possible time.

The prior art has addressed this problem of heat transfer, in a number of ways. H. G. Zimmerman, et al., U.S. Pat. No. 2,876,634, teaches the use of metallic fins integral to the inner wall of the cup and directed into the wax. E. A. Rollor, Jr, U.S. Pat. No. 3,463,140, shows the use of non-integral fins of corrugated metal foil dispersed through the volume of the wax. This patent also discloses a method for brazing these foil fins to the wall of the cup to ensure good thermal contact. J. W. Ryan, et al., U.S. Pat. No. 3,603,106, discloses a means for temporarily increasing the thermal conductivity of the wax by mixing the wax with fine particles of aluminum. All of these techniques serve to reduce the effective thermal resistance within the wax itself.

SUMMARY OF THE INVENTION

This invention achieves the rapid temperature regulation of a contained, heated beverage and improves heat storage, through the use of a container whose bottom inner wall protrudes, as a cylinder, into the center volume of the beverage.

The effect of this central cylinder in rapidly regulating the beverage temperature appears to be threefold: the central cylinder increases the beverage to cup wall interface surface area by the surface area of the cylinder, thereby reducing the overall effective thermal resistance of this interface; the central cylinder reduces the average distance between any element of the beverage and the cup wall thereby reducing the effect of the beverage's thermal resistance, for a given container volume; and lastly the displacement volume of the central cylinder necessitates a larger circumference of the outer vessel wall thereby increasing that wall's surface area for a given volume of beverage.

The effect of the central cylinder in providing improved heat storage is felt to be twofold: heat stored in the wax held by the cylinder has no direct path of escape to the outside air, as does the wax held between the outer walls, therefore less stored heat escapes to the air; and the cylinder, by removing the need for circumferential fins extending the full width of the outer wall, reduces the path of heat loss along those fins to the outer air.

The lack of fins permeating the wax may also help improve the crystallization of the wax as it cools thereby increasing the ability of the wax to release additional heat to the beverage as it cools.

Thus it is the object of this invention to provide the benefits of rapid temperature regulation and improved heat storage without the necessity of fins or additions to the wax, thereby providing a design that is readily fabricated and less expensive to produce.

Other objects and advantages of the present invention will become apparent upon reading the specification when taken in conjunction with the accompanying drawing.

DETAILED DESCRIPTION OF THE PREFERRED EMBODIMENT

Figure 1:
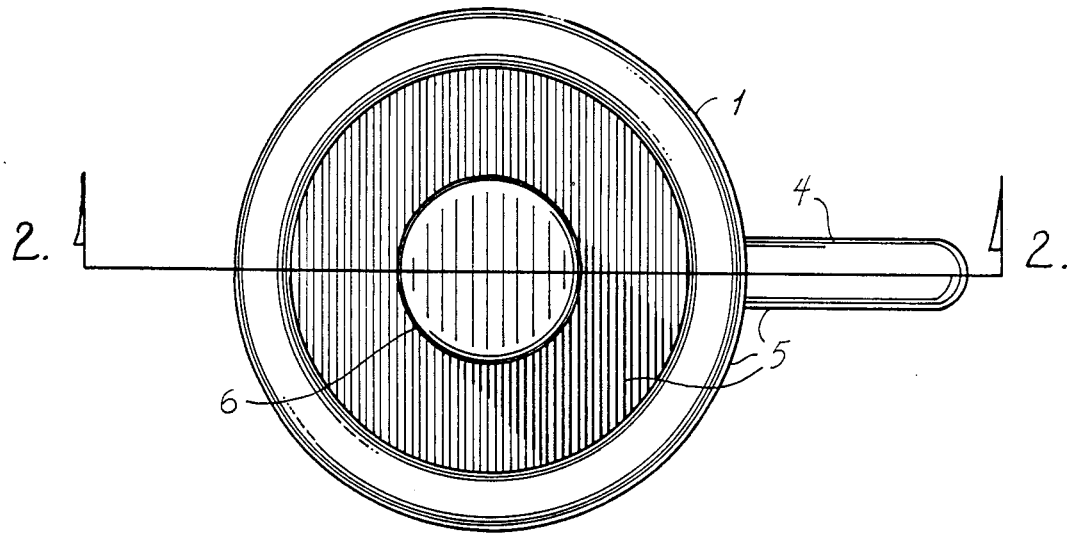
FIG. 1 is a top-view of the container made in accordance with this invention.
Figure 2:
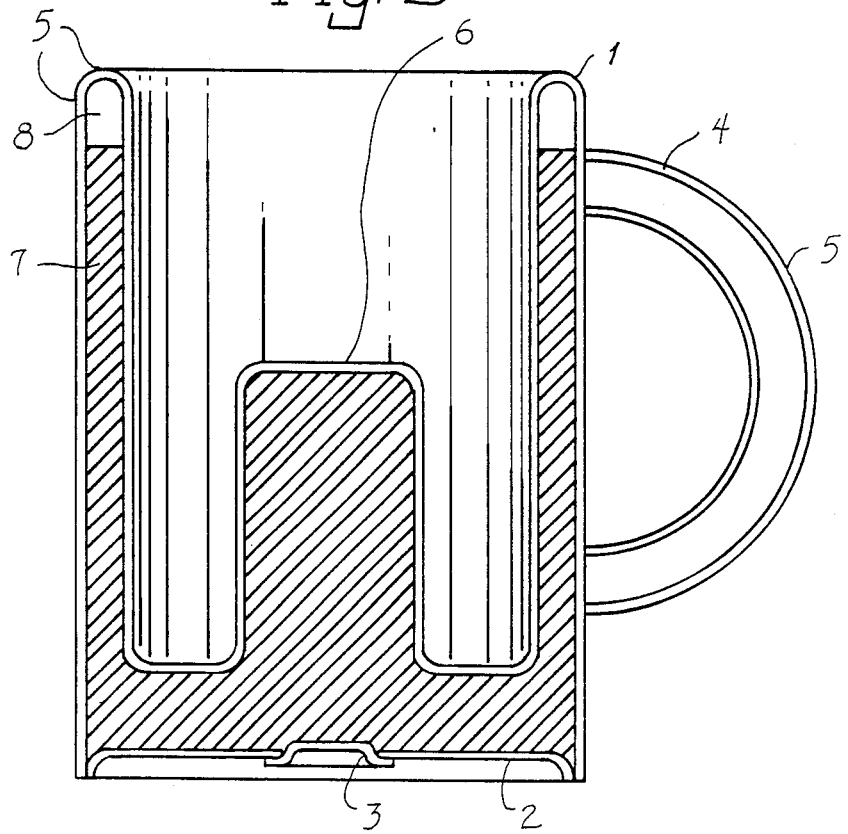
FIG. 2 is a cross sectional view taken along line 2—2.

A beverage container typifying the present invention as shown in FIG. 1 includes a single piece, deep drawn aluminum shell (1), which forms the entire inner surface and the outer vertical surface of the cup as one seamless unit. A compression fitted first bottom plug (2), as shown in FIG. 2, forms the majority of the outermost bottom surface of the container and in turn is fitted with a second, smaller plug (3) to permit a quantity of wax to be inserted into the hollow walls of the container as contained within shell and the plugs. The resultant geometry of the cup not only provides that all seams are removed from the beverage contacting portions of the cup but allows a simple press fit to complete the fabrication of the unit. Thus, assembly of the unit is simplified and its hygenic characteristics are improved. Importantly, this design provides that the initial thermal expansion, occurring when the inner metal surfaces of the container contact a hot beverage, does not loosen the the bottom compression joint, such expansion serving instead to slightly increase the compressive force on this joint and hence its strength.

A handle (4) is welded to the outer vertical wall of the shell, and in the preferred embodiment, the exposed surfaces of the assembled container are given a covering of porcelain enamel (5) to provide a finish resistant to mild food acids and staining yet capable of readily conducting heat through its surface.

A central cylinder (6) is formed in the bottom inner surface of the container, extending upwards to the center of the cup. The space inside of the central cylinder and between the inner and outer walls of the cup is filled with wax (7) as a phase change material, except for a small air space (8) to provide expansion room for the wax as it melts.

As mentioned, a large central cylinder size is to be preferred because it provides a large heat transfer area for the given volume of beverage, both by means of its own dimensions, and by increasing the overall volume of the cup, and hence the inner surface area of the outer wall of the cup. Additionally, a large central cylinder size reduces the restriction in heat flow brought about by the beverage's internal thermal resistance by reducing, for a given beverage volume, the beverage's average thickness.

A number of practical considerations limit the central cylinder size, however. Too large a cylinder may produce a cup of awkward dimensions, and a cylinder that rises too close to the surface of the filled cup makes drinking difficult and diminishes the heat transfer advantage of the cylinder's upper surface. The thermal resistance of the wax limits the useful cylinder diameter: the wax at the center of a sufficiently large cylinder will not melt in time to substantially affect the cooling of the beverage. The cylinder size is also limited by the desired wax-to-beverage volume ratio: the larger the cylinder for a given volume of beverage, the larger this ratio. If the ratio is too large, the wax will not rise sufficiently in temperature to reach its phase change point and the cup's ability to regulate temperature will be lost.

For a cup volume of 1¼ cups of beverage, the following dimensions have proven satisfactory: an internal cup height and cup diameter of 3⅞" and 2⅝" respectively, an outer vertical wall thickness and bottom wall thickness of ¼" and ½" respectively, and a central cylinder height and central cylinder diameter of 2" and 1¼" respectively.

These dimensions are intended to be representative only and may be varied within the limits described above or adjusted to some extent in response to differing aesthetic judgements.

The phase change material in the preferred embodiment, american paraffin, is chosen because of its low toxicity, suitable melting point of approximately 140 degrees F. and relatively high heat of fusion of approximately 38 Calories per gram or more. It should be apparent to one skilled in the art that numerous other materials having similar properties may be substituted in this application including other waxes, such as beeswax, certain low melting point alloys and a wide variety of eutectic materials. See generally, Kauffman, K. and Gruntfest, I., Report NCEMP-20 of the University of Pennsylvania National Center for Energy Management and Power to NSF (1973), "Congruently Melting Materials for Thermal Energy Storage", (describing, among others, eutectic mixtures of $Mg(NO_3)_2.6H_2O$-$Al(NO_3)_3.9H_2$ and of Acetamide and Stearic Acid. Clearly the use of materials of higher or lower melting points than that of paraffin could be used to adjust the container's regulation to a higher or lower temperature as desired.

Figure 3:
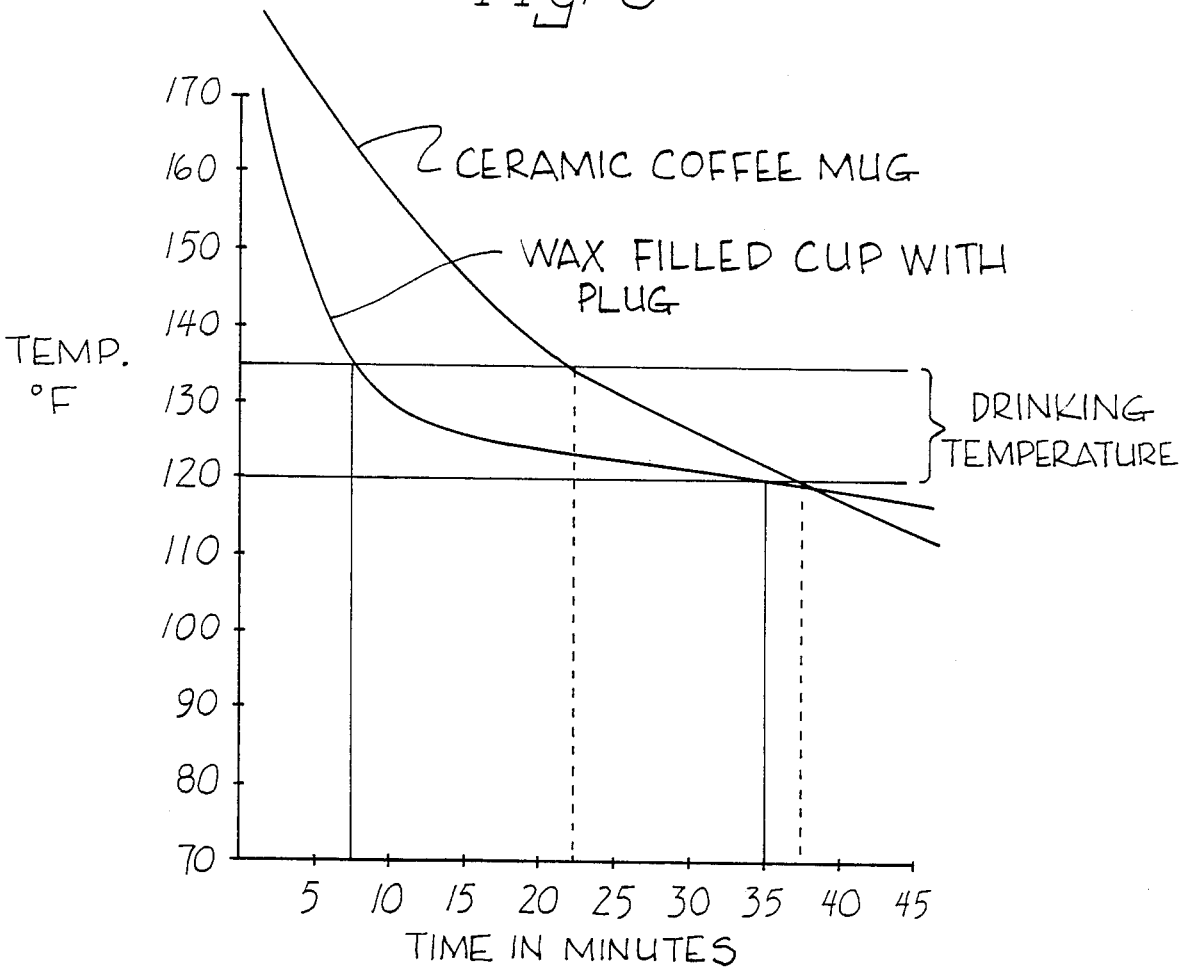
FIG. 3 is graph depicting the temperature of a beverage, as a function of time, when the beverage is contained: firstly, in a conventional ceramic coffee cup and secondly, in a cup constructed according to the present invention.

Referring now to FIG. 3 there is shown an experimentally derived graph of temperature as a function of time for identical volumes of water held in a conventional ceramic coffee mug, in a container constructed according to the preferred embodiment of the invention, and for comparison, in a container constructed according to the preferred embodiment but without the central cylinder. It can be seen that the invention so described provides both an increase in the time during which the temperature of the beverage is within the preferred temperature range, and also a decrease in the time the beverage takes to cool to that preferred temperature range.

It is thought that the invention and many of its attendant advantages will be understood from the foregoing description and it will be apparent that various changes may be made in the form, construction and arrangement of the parts without departing from the spirit and scope of the invention the form described herein being merely a preferred embodiment thereof.

I claim:

1. A regenerative beverage container comprising:

(a) a substantially cylindrical hollow outer wall disposed about a vertical axis and open at the upper end thereof for receiving a beverage.

(b) a substantially planar hollow bottom wall closing the lower end of said outer wall, (c) a hollow central member extending upwardly from said bottom wall coaxially within said outer wall to form with said outer wall a beverage receiving space therebetween, and (d) a phase change material received within the hollow portions of said outer wall, said bottom wall and said central member to regeneratively absorb heat from a preheated beverage received within said container and then to release the heat to the beverage to maintain the beverage at a desired temperature for an extended period, said phase change material changing state at a temperature within the range of 110 degrees F. to 150 degrees F.

2. A beverage container as defined in claim 1 wherein said central member comprises a hollow central cylinder.

3. A beverage container as defined in claim 1 wherein said bottom wall is hollow and said phase-change material is received within said hollow bottom wall.

4. A beverage container as defined by claim 1 in which said central member extends upwardlly from said bottom wall for a distance at least equal to 10% but no more than 90% of the vertical length of said outer wall and the diameter of said central cylinder is at least equal to 5% of the inner diameter of said outer wall.

5. A beverage container as defined by claim 1 in which said phase change material is paraffin having a melting point of substantially 140 degrees F.

6. A beverage container as defined in claim 1 in which the walls, bottom and central cylinder are constructed of porcelain enamelled metal.

7. A beverage container as defined in claim 1 in which the walls, bottom and central cylinder are constructed of porcelain enamelled aluminum.

8. A method of prolonging the drinking temperature of a preheated beverage comprising the steps of:

(a) introducing a heated beverage into a substantially cylindrical container comprising:

(i) a hollow outer wall disposed about a vertical axis and open at the upper end thereof for receiving the beverage, (ii) a substantially planar hollow bottom wall closing the lower end of said outer wall, (iii) a hollow central member extending upwardly from said bottom wall coaxially within said outer wall to form with said outer wall a beverage receiving space therebetween.

(iv) and a phase change material received within the hollow portions of said outer wall, said bottom wall and said central member, said phase change material changing state at a temperature within the range of 110 degrees F. to 150 degrees F., (b) regeneratively absorbing heat from the beverage received within said container into the phase change material (c) releasing a portion of the absorbed heat back into the beverage so as to maintain the beverage at a desired temperature for an extended period.

* * * * *